United States Patent [19]

Chomarat et al.

[11] Patent Number: 5,047,276

[45] Date of Patent: Sep. 10, 1991

[54] MULTILAYERED TEXTILE COMPLEX BASED ON FIBROUS WEBS HAVING DIFFERENT CHARACTERISTICS

[75] Inventors: Gilbert F. Chomarat, Les Gets; Andrë Fourezon, Le Cheylard, both of France

[73] Assignee: Etablissements les Fils D'Auguste Chomarat et Cie, France

[21] Appl. No.: 259,698

[22] Filed: Oct. 19, 1988

[30] Foreign Application Priority Data

Nov. 3, 1987 [FR] France ..... 87 15461

[51] Int. Cl.[5] ..... B32B 5/12

[52] U.S. Cl. ..... 428/110; 428/233; 428/234; 428/247; 428/280; 428/282; 428/284; 428/285; 428/287; 428/299; 428/304.4

[58] Field of Search ..... 428/299, 284, 285, 287, 428/282, 247, 110, 304.4, 246, 280, 238, 239, 233; 28/104

[56] References Cited

U.S. PATENT DOCUMENTS

| | | | |
|---|---|---|---|
| 33,023 | 8/1989 | Hero | 428/301 |
| 4,237,180 | 12/1980 | Jaskowski | 428/299 |
| 4,542,060 | 9/1985 | Yoshida et al. | 428/299 |
| 4,784,903 | 11/1988 | Hiss | 428/299 |
| 4,840,838 | 6/1989 | Wyss | 428/299 |
| 4,948,649 | 8/1990 | Hiers et al. | 428/285 |
| 4,957,805 | 9/1990 | Biggs et al. | 428/299 |

FOREIGN PATENT DOCUMENTS

| | | |
|---|---|---|
| 0176847 | 4/1986 | European Pat. Off. . |
| 2562472 | 10/1985 | France . |
| 1515455 | 6/1978 | United Kingdom . |

*Primary Examiner*—James J. Bell

*Attorney, Agent, or Firm*—Parkhurst, Wendel & Rossi

[57] ABSTRACT

A multilayer textile complex comprising:

a first web of synthetic fibers selected from the group consisting of polyester, polyamide and polypropylene; and a second web of mineral fibers selected from the group consisting of glass and asbestos; and an inner reinforcing structure sandwiched between said first and second web; wherein said first and second web are connected to each other by a minor amount of the synthetic fibers of said first web implanted within the mineral fibers of said second web without protruding through an outside surface of said second web.

4 Claims, 1 Drawing Sheet

MULTILAYERED TEXTILE COMPLEX BASED ON FIBROUS WEBS HAVING DIFFERENT CHARACTERISTICS

The present invention relates to a new type of material composed of a multilayer textile complex produced from fibrous laps which can be used either as such or as coating supports or reinforcing structures of resin-based laminated articles or of and impermeable covering composed of a support embedded in a bitumen composition.

For a very long time, there have been proposals for producing multilayer textile complexes based on fibrous nonwoven laps having different characteristics, these complexes being reinforced., if appropriate, by a core woven, nonwoven or of any other material, for example a layer of foam, this being for the purpose of giving them the best possible properties according to their uses.

Thus, for example, there was the idea of producing nonwoven/fabric complexes and/or combining laps based on different materials, for example a polyester nonwoven and a lap of glass fibers.

In all these complexes, the main problem that arises is that of connecting the various textile layers to one another. Hitherto, the main proposals for making this connection have involved combining the various layers with one another by adhesive bonding (see U.S. Pat. No.-A-4,539,250 and U.S. Pat. No.-A-4,491,617), by stitching and knitting (U.S. Pat. No.-A-3,044,146) or by needling (see FR-A-2,562,472 corresponding to U.S. Pat. No. 4,576,858).

Although the techniques employing adhesive bonding make it possible to obtain complexes, the outer faces of which can be based on materials having different characteristics, for example one face composed essentially of synthetic fibers (polyester, polyamide, etc.), whilst the other face is composed of mineral fibers (for example, glass), nevertheless, because of the presence of an adhesive, they have the disadvantages of presenting problems when the structure so produced is to be impregnated or coated. Thus, for example, when such a complex material is to be used as a reinforcing structure of an impermeable covering based on a bitumen composition, the presence of glue gives rise to risks of aqueous residues in the product which are very often the cause of the formation of bubbles in the bitumen. Moreover, the presence of glue gives the complex produced a certain stiffness or rigidity. Finally, despite the advances made in the sector of glues, risks of delamination between the layers still persist.

The Applicant, in his French Patent 2,562,472 (corresponding to U.S. Pat. No. 4,576,858), proposed a new type of material which makes it possible to solve this problem of connection between the layers and obtain highly homogeneous complexes, this being achieved without the addition of binding materials. According to this document, the various layers of materials are intermixed intimately and connected mechanically to one another, the connection between the various layers being made by needling. This solution makes it possible to provide various multilayer complexes, such as, for example, complexes composed of glass fibers and polyester fibers, if appropriate combined with additional reinforcing elements, such as, in particular, nonwoven nets. However, it was found that the action of the needles during the connection of the fibrous laps, more particularly when additional reinforcements (woven or nonwoven nets, foam sheets, etc.) were combined with the laps, could result in damage to the reinforcements. Furthermore, according to the teachings of this patent, the needling operation makes it possible to implant the fibers of the laps, especially glass fibers, in the entire thickness of the other lap composed, for example, of a polyester nonwoven, in such a way that the fibers of the first lap on which the action of the needles is exerted project on each side of the other lap which therefore serves as a support. Consequently, in the finished complex, the outer faces are both based on fibers of the same type.

Now a new type of material has been found, this being the subject of the present invention, which, like that described in the abovementioned patent, is based on fibrous laps having different characteristics, the laps being connected to one another as a result of the interlacing of the fibers of one of the laps with those of the second lap, and, by a suitable selection of the fibrous laps joined together and by the choice of an interlacing technique, known moreover, carried out under specific conditions, namely the technique of "needling" employing not needles, but the action of jets of fluid under pressure (air or water), not only makes it possible to preserve the characteristics (resistance, good bonding of the laps with one another without the addition of glue, etc.) of the articles obtained according to the abovementioned patent, but also has the particular feature of exhibiting outer surfaces which are composed, if not completely, at least for the most part of fibers of one and the same type, each face preserving the specific properties of the fibers of each of the original laps involved in the production of the complex.

The multilayer textile complex according to the invention is defined in that:

one of the laps involved in its composition is based on non-brittle flexible synthetic fibers, such as fibers of polyester, polyamide, polypropylene etc.;

the other lap is based on relatively rigid and brittle mineral fibers (such as glass, asbestos, etc.); and a minor proportion of the synthetic fibers is implanted in the thickness of the lap based on mineral fibers, without protruding at the surface of the latter.

In other words, in the material according to the invention, the fibers making the connection between the various layers are synthetic fibers reoriented in the direction of the thickness of the multilayer complex, the reorientation being carried out in such a way that it passes through the entire stack formed, but without protruding outside the layer based on mineral fibers, so as not to impair the surface properties of the latter. At most, the ends of the synthetic fibers implanted in this way will be flush with the surface of the lap based on mineral fibers.

If the material according to the invention can be composed solely of nonwoven fibrous structures, then of course it would be possible to combine with it an inner reinforcing structure, such as a woven or nonwoven textile net, a foam sheet, a felt, a film or any combination of such elements.

The invention also relates to a process making it possible to obtain such a complex, this process involving superposing at least two nonwoven fibrous laps produced by dry means (carding in particular), one of these laps being composed of non-brittle flexible synthetic fibers and the other of relatively rigid and brittle mineral fibers, the process according to the invention being defined in that the stack of laps so produced is subjected to the action of jets of fluids (air or water) acting on the superposed materials on the surface of the lap based on synthetic fibers, so as to reorient some of the fibers in the direction of thickness, during the action of the jets the stack being supported by a permeable continuous surface, preventing the synthetic fibers from protruding outside the surface of the lap based on mineral fibers.

According to the process of the invention, it is possible to interpose between the two abovementioned fibrous laps any additional element, such as, for example, a (woven or nonwoven) textile net, a fabric, a knit, a foam sheet, etc., these elements being interposed alone or in combination with one another, depending on the desired results, and all the layers being connected to one another by means of the synthetic fibers reoriented in the direction of thickness. It is clear that it must be possible for the jets of fluid to pass through these additional layers.

Furthermore, according to a preferred embodiment of the process according to the invention, according to which embodiment jets of water are used as jets of fluid, it is advantageous, before subjecting the superposed materials to the action of the jets, to compress them, preferably at the same time moistening them, in such a way that the operation takes place with a stack having the smallest possible thickness in relation to the number of layers involved in its composition.

The new materials according to the invention have very many advantages in comparison with the prior multilayer materials, in that the flexible synthetic fibers (for example, polyester) which penetrate through the lap based on rigid fibers (glass) make it possible to obtain a single composite material of small thickness free of any addition of glue, allowing numerous uses, such as, for example, the reinforcement of roofing sheets, resinbased laminated structures, etc.

Moreover, such a connection between the layers prevents any risk of delamination, and the fibrous hooks obtained as a result of the penetration of the jets on the nap of synthetic fibers through the nap of mineral fibers make it possible to obtain a laminated composite material without glue, making the penetration of bitumen, resin, etc., easier.

Furthermore, the absence of glue reduces the risks of aqueous residues in the product which are very often the cause of the formation of bubbles.

Moreover, since the mineral fibers (glass) are arranged on only one face of the complex, this makes it possible to provide finished products (for example, bituminous coverings) conforming to the characteristics required for fireproofing problems.

Producing the complex as a result of the connection by means of jets makes it possible to obtain a product of high flexibility which cannot be produced as a result of a connection of the various layers in the conventional way by means of an adhesive.

Finally, it was found, particularly when the lap based on mineral fibers is composed of glass fibers, that the fibers of this lap which are intimately connected to the synthetic fiber (polyester) have advantageous properties of tensile strength, dimensional stability under heat, wearing resistance and deterioration, such as can be attributed, for example, to ultraviolet rays.

However, the invention, the advantages which it affords and the various uses which such a material can have will be understood better from the exemplary embodiments which are given below as an indication, but in a non-limiting way, and which are illustrated by the two accompanying Figures of which:

FIG. 1 illustrates in general terms, in an exploded perspective view, the structure of the material according to the invention which is composed of fibrous laps (1, 2) having different characteristics, these laps being connected to one another as a result of the interlacing of the fibers (3) of one of the laps (1) with those of the second lap (2).

Figure 1:
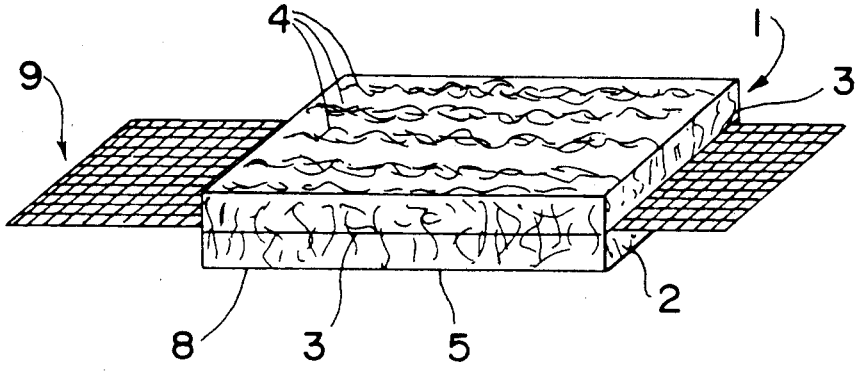
FIG. 1 is a diagrammatic perspective view showing the general structure of the material according to the invention which, in this embodiment, has an additional inner reinforcing structure.

According to the invention, in this particular case one of the laps (1) is based on non-brittle flexible synthetic fibers, whilst the other lap (2) is based on relatively rigid and brittle mineral fibers, such as, for example, fibers of glass, asbestos, carbon, etc.

To obtain a material according to the invention, in which the outer faces (4, 5) of the complex preserve the characteristics of the original fibrous laps (1, 2), the laps are combined with one another in such a way that flexible synthetic fibers are made to penetrate inside the lap based on mineral fibers. For this purpose, use is made of the technique of interlacing or entanglement which is designated by technicians by the expression "hydraulic intermingling" and the principle of which is shown diagrammatically in FIG. 2, and which, in general terms, involves subjecting the superposition of fibrous laps to the action of jets of fluid coming from nozzles (6). According to the invention, the superposed laps (1) and (2) are brought underneath the nozzles (6) by means of a conveyor belt (7) making it possible to keep them flat during the intermingling operation. During this operation, the lap on which the jets of fluid are exerted directly is the lap (1) composed of synthetic fibers, whilst the lap (2) is maintained on the supporting belt (7). As a result of such a procedure, under the action of the jets of fluid coming from the nozzles (6), some (3) of the fibers of the lap (1) are reoriented so as to penetrate into the lap (2), the ends (8) of the fibers so reoriented being at most flush with the lower surface (5) of the lap (2) which is in contact with the supporting belt (7).

As a result of this procedure, the upper surface (4) of the lap (1) has small perforations which are virtually invisible, because of the orientation of the fibers, and which are distributed at random, this upper surface being composed, of course, solely of synthetic fibers, whilst the surface (5) of the lap based on mineral fibers preserves its original properties, for example its fireproof characteristics when the fibers of the lap (2) are based on glass.

Of course, the properties will depend on the material selected.

If the material according to the invention can be composed solely of fibrous laps connected to one another in this way, however, it is preferable, particularly in order to give the complex characteristics of mechanical tensile strength both longitudinally and transversely, to incorporate between the two laps (1, 2) an additional reinforcement (9) composed, for example, of a (woven or nonwoven) textile net, a fabric, a knit, etc., based on a material which can be either identical to one of the materials forming the laps (1, 2) or different. Of course, the structure of this additional reinforcement must be such that the fibers (3) of the lap (1) which are reoriented can pass through it under the action of the jets of fluid (6).

EXAMPLE 1

A material according to the invention is produced from the following two components:

for the fibrous lap (1) based on flexible synthetic fibers, a nap of polyester obtained by carding from 6.6 Dtex fibers, cut 50 mm, weighing 150 g/m$^2$ and having a mean thickness of 5 mm;

for the lap (2) based on mineral fibers, a nap of glass fibers having a length of 50 mm and a diameter of 14 microns, weighing 75 g/m$^2$ and having a mean thickness of 2 mm.

Figure 2:
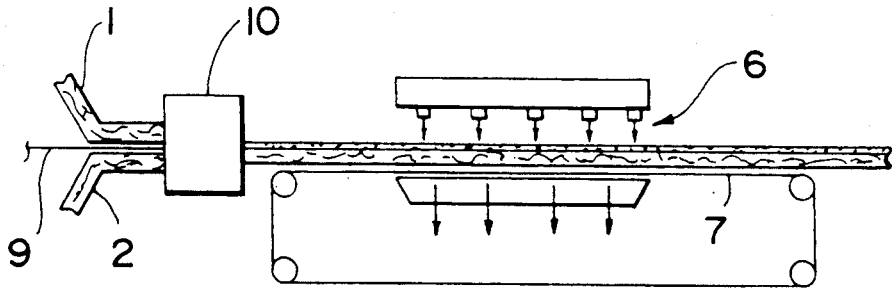
FIG. 2 illustrates diagrammatically, in a side view, the operating process for obtaining such a material.

These two laps (1, 2) are superposed and delivered to an installation of the type shown in FIG. 2, in such a way that the lap (1) is located opposite the jets of fluid (6). Before treatment by the jets of fluid (6), the complex formed is preferably subjected to the action of means (10) (not shown in FIG. 2) making it possible to compress it and, when the jets of fluid are jets of water, moisten the laps thus compressed.

The pressure of the jets of fluid will be variable as a function of the thickness of the number of superposed laps, this pressure generally being between 30 and 150 bars and, in this particular case, being of the order of 70 bars.

At the exit of the installation, the complex obtained is composed of two different fibrous laps connected perfectly to one another, and the fibers (3) of the lap (1) which have been driven through the latter (2) do not project relative to the surface (5) of this lap.

Such a material can have many uses, particularly as a coating support, for example for producing a bitumen layer reinforcement.

EXAMPLE 2

Example 1 is repeated, but between the two laps (1, 2) is interposed a net (9) based on glass filaments (silionne) having four filaments and four picks per centimeter, each filament having a count of 51 Tex. This net weighs 50 g/m$^2$.

After treatment according to the invention, the complex structure obtained has exactly the configuration which is given in FIG. 1 and in which one of the faces (4) is based on polyester fibers, whilst the other face (5) is based on glass fibers.

Such a material is especially suitable for use as a bitumen support, making it possible to produce a single-layer impermeable covering, in order to obtain a covering having excellent characteristics of dimensional stability and of static and dynamic puncture resistance The material described above can be stored and handled easily. Moreover, the properties of each of the layers are preserved, this being especially useful when it is desirable, for example, to make one face fireproof and the other face insulating. Furthermore, the intermingling operation obviously gives rise to ducts within the complex which assist the penetration of resins, bitumens or any other materials which it would be desirable to combine with such a complex.

Of course, the invention is not limited to the exemplary embodiments, but embraces all their alternative versions produced in the same spirit.

Thus, although, in the preceding example, each of the laps (1, 2) was composed of the same type of fibers, it would be possible to include various additives in these laps or mix them with other fibers. For example, it would be possible to incorporate inside the lap based on thermoplastic fibers thermofusible fibers having properties which could be revealed at a later time, fibers capable of curling or revealing other properties, making it possible to achieve greater cohesion (for example, bilaminar fibers).

We claim:

1. A multiplayer textile complex comprising:

a first web of non-brittle flexible synthetic fibers selected from the group consisting of polyester, polyamide and polypropylene; and a second web of rigid and brittle mineral fibers selected from the group consisting of glass and asbestos;

wherein said first web and said second web are connected to each other by a minor another of the synthetic fibers of said first web implanted within the mineral fibers of said second web without protruding through an outside surface of said second web.

2. The multilayer complex of claim 1, further comprising an inner reinforcing structure sandwiched between said first web and said second web.

3. The multilayer complex of claim 2, wherein the inner reinforcing structure is a woven or nonwoven material selected from the group consisting of a textile net and a fabric.

4. The multilayer complex of claim 2, wherein the inner reinforcing structure is a foam sheet or a felt.

* * * * *